US005605389A

United States Patent [19]

Kelly et al.

[11] Patent Number: 5,605,389

[45] Date of Patent: Feb. 25, 1997

[54] CABINET, BOOKCASE, LOCKER AND CUBBY STRUCTURES

[75] Inventors: Ray G. Kelly; Sharon A. Turnbough, both of St. Louis, Mo.; Allan Flowers, San Diego, Calif.; Douglas L. Blocker, Jefferson, Mo.

[73] Assignee: Angeles Group, Inc., Pacific, Mo.

[21] Appl. No.: 307,162

[22] Filed: Sep. 16, 1994

[51] Int. Cl.[6] ..... A47B 43/00; A47B 43/02; A47B 47/00; A47B 47/06

[52] U.S. Cl. ..... 312/258; 312/108; 312/259; 312/351; 220/462; 220/463; 220/470; 220/645; 206/523; 206/594

[58] Field of Search ..... 312/107, 108, 312/262, 258, 259, 257.1, 351, 348.3; 220/462, 463, 470, 645; 206/523, 594; 52/631; 229/930, 120.34

[56] References Cited

U.S. PATENT DOCUMENTS

| | | | |
|---|---|---|---|
| 3,592,344 | 7/1971 | Schade | 312/108 |
| 3,812,977 | 5/1974 | Glassman | 312/107 |
| 3,906,127 | 9/1975 | Hollmann et al. | 428/73 |
| 4,124,260 | 11/1978 | Bergman | 312/107 |
| 4,134,564 | 1/1979 | Hanna | 108/110 |
| 4,429,932 | 2/1984 | Brennan | 312/259 |
| 4,463,997 | 8/1984 | Densen | 312/259 |

FOREIGN PATENT DOCUMENTS 2670122 12/1992 France .

*Primary Examiner*—Peter M. Cuomo
*Assistant Examiner*—Anthony D. Barfield
*Attorney, Agent, or Firm*—Paul M. Denk

[57] ABSTRACT

A storage unit, in the category of a cabinet, bookcase, locker and cubby, as provided which includes a frame defining top, bottom, and side walls to the storage unit. At least one shelf member and at least one shelf supporting member are received in the frame to divide the frame into separate storage cubicles or lockers. The frame is made from two blanks. A first blank forms the top and at least a part of the sides. The second blank forms at least a part of the bottom and may form a part of the sides. Each blank, as well as the shelves and shelf supports, are made from a core having upper and lower surfaces which are covered with a coating. The coating extends beyond edges of the blanks to define a channel which receives a finishing piece. Grooves are formed in the top blank to define bending points and separate the what will be the top of the frame from the sides of the frame. Shallower grooves are formed in the first and second blanks and define one guide channels for the shelves and shelf supports. The structure of the storage units provide sturdy and stable units which may be shipped in pieces and assembled on site without the need for tools.

17 Claims, 7 Drawing Sheets

17b
29b
27b
21
23
19b
15b
31b
13b
33b
15a
31a
13a
33a
29a
27a
17a
19a
22a 15d
31d
13d
33d
17d
36d
29d
27d
38d
19d
30
27c
19c
38c
36c
29c
34c
17c
31c
15c
13c
33c

CABINET, BOOKCASE, LOCKER AND CUBBY STRUCTURES

BACKGROUND OF THE INVENTION

This invention relates to furniture for use in nurseries, kindergarten classrooms and the like, and in particular to shelving units and lockers for use in such rooms.

Storage units, such as book cases, cubby hole boxes or cubbies, and cabinets or lockers have long been used. They are often used in nurseries, kindergarten classrooms, and the like. In this environment, it is desirable that the storage unit be fully stable, easily cleaned, that it can support the weight of a small child, and that no sharp corners be present.

Further, for purposes of shipping, it is desirable that the storage unit can be sold in an unassembled state, and then be easily assembled on site, if desired. But providing such functions in a disassembled state usually leaves something to be desired regarding its structural strength and stability.

SUMMARY OF THE INVENTION

One object of the present invention is to provide storage structures for use in nurseries, kindergarten rooms, etc.

Another object is the provision of such storage structures which are made of light weight material.

Another object is the provision of such storage structures which are strong and sturdy, and possess full stability.

Another object is the provision of such storage structures which are easily cleaned.

Another object is the provision of such storage structures which may be easily assembled, preferably without the use of tools.

Another object is the provision of such storage structures which are economical and simple to produce.

A further object of this invention is to provide the structure for a cabinet, bookcase, cubby, or the like, wherein the various exposed corners and edges for the fabricated structure are maintained in a rounded configuration, not only to add to the pleasing appearance of the device, but to enhance the safety of its usage.

A further object of this particular invention is to provide a furniture structure that is provided with soft and resilient edges, also for the safety of any young children utilizing the same.

Still a further object of this particular invention is to provide storage structures, of the type as previously identified, and wherein their bases are fabricated of greater dimensions, both wider in width, and deeper in depth, so as to add to the stability of such structures when utilized particularly by young children.

Still another object of this invention is to provide a storage structure fabricated to function in the capacity of a locker.

These and other objects will become apparent to those skilled in the art in light of the following disclosure and accompanying drawings.

In accordance with the invention, generally stated, a storage unit of the present invention includes a frame which defines top, bottom, and side walls to the storage unit. At least one shelf member and at least one shelf supporting member are received in the frame to divide the frame into separate storage cubicles or lockers. The frame is made from two blanks. A first blank forms the top and at least a part of the sides. The second blank forms at least a part of the bottom and may form a part of the sides. Other configurations may be used. Each blank is made from a core having upper and lower surfaces which are covered with a coating. The coating extends beyond edges of the blanks to define a channel which receives a finishing piece. These finishing pieces may be rounded, and also preferably may be fabricated of resilient type material, to not only reduce the incident of any injury to a user, but also to cushion against any one leaning against the unit. The top blank includes a pair of grooves extending through one coating surface and the core to define bending points and separate that which will be the top of the frame from the sides of the frame. The first and second blanks each have at least one guide channel for each of its top, bottom and sides. The guide channel extends through the inner coating surface at at least a portion of the core. The guide channel of opposing walls of the frame are aligned to received the shelves and shelf supports in a generally level manner. Preferably, liners are provided for the guide channels to prevent damage to the core when the shelf and shelf supports are inserted and passed along the channel.

The shelf support and shelves each include a core having an upper and a lower surface and a laminar liner or coating which covers each surface. The liner extends beyond at least a front edge of the shelf supporting and the shelf define a channel which receives a finishing piece. The shelf and shelf support each include at least one slot which cooperate with each other to support the shelf in the assembly.

The cores of the blanks, shelf members, and shelf support members are made of light weight corrugated paperboard, honey-combed paperboard, expanded foam, or expanded resin. The finishing pieces for said shelf member and said shelf supporting member include a generally hollow foot section received in the channels and a generally convex head section extending outwardly from said channels. The finishing piece for the frame is substantially the same, but includes a wall separating the head from the foot section. The front and perhaps the back finishing piece for the frame also may includes a corner piece which is placed at the junctions of the top, sides, and bottom.

A further desirable feature of this invention is to provide the structure of a storage unit, whether it be a cabinet, bookcase, cubby, or locker, and wherein the lower portion of the unit has greater depth and/or width than its top, so as to significantly enhance the stability of the storage unit, when applied.

As will be explained, the structure of the storage units provide units which may be shipped in parts and then assembled on site without the use of tools. Or the units can be fully assembled at the plant and shipped.

BRIEF DESCRIPTION OF THE DRAWINGS

FIGS. 9E–F are plan views of shelving pieces of the locker;

Corresponding reference numerals indicate similar parts throughout the various drawings.

DESCRIPTION OF THE PREFERRED EMBODIMENTS

Turning to FIGS. 1–4, various storage structures 1*a–d* are shown. FIGS. 1A–F show a cubby 1*a* having a plurality of storage cubbies 3*a*. FIGS. 2A–F show a book case 1*b* having a plurality of openings 3*b* which receive books or the like. FIGS. 3A–E show a double sided book case 1*c* having a plurality of openings 3*c* which receive books or the like. Unlike bookcase 1*b*, double sided bookcase 1*c* has openings on both its front and back to receive books or the like. FIGS. 4A–F show a locker unit 1*d* defining a plurality of lockers 3*d*. Each of the units 1*a–d* includes a bottom 5*a–d*, top 7*a–d*, and side walls 9*a–d*. All but the double sided book case 1*c* have back walls 11*a,b,d*. The double sided bookcase 1*c* does, however, have a centerboard 11*c* which separates the bookcase opening into front and back openings. Further, each unit has at least one shelf 13*a–d* and shelf supporters 15*a–d* which support the shelves 13*a–d* and divide the shelves into individual compartments 3*a–d*. Locker 1*d* includes hooks 16 secured to shelf supporters 15*d* near an upper part of a middle portion of the lockers 3*d*. All the units also have at least one sloped edge, as seen in side elevation, to give the units a trapezoidal shape. Preferably units 1*a,b,d* have a sloped front and a flat back and unit 1*c* has a sloped front and back. By giving the units a trapezoidal shape, they have a larger bottom than top, making the units more stable.

Figure 10:
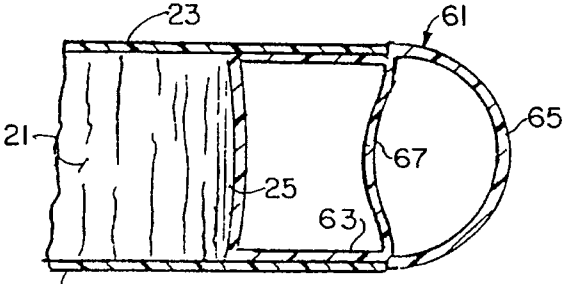
FIG. 10 is a cross-sectional view taken along line 10—10 of FIG. 1F, 2A, 3E, and 4D.
Figure 15:
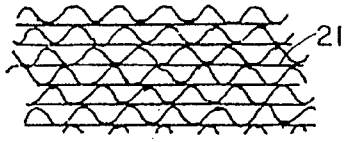
FIG. 15 is a cross-sectional view taken along line 15—15 of FIG. 13 showing the construction of the core of the structures.

The individual parts for the storage units 1*a–d* are shown in more detail in FIGS. 5–8 and the construction of units 1*a–c* are substantially identical. The walls of the units are made of one or more pieces or blanks. In the preferred embodiment, blanks 17*a–c* form the top, sides, and part of the bottom of units 1*a–c*, and blanks 19*a–c* form the middle part of the bottom. The structure of blanks 17*a–c* and 19*a–c* is shown in FIG. 10. Each blank includes a core 21 made of corrugated or honey-combed paperboard (shown in FIG. 15) which may be resin treated to add further stiffness to the core. Other light weight materials, such as styrofoam or foamed resins, may also be used to form the core. The core 21 is covered on its top and bottom (or inner and outer) surfaces by a liner or coating 23 which extends beyond the forward edges of the core to define a channel 25. These inner and outer liners 23 are preferably Formica, or similar coating, such as a resin-paper laminate, or the like, which may be easily washed and may be formed in many colors.

Blanks 17*a–c* and 19*a–c* are provided with a plurality of narrow grooves 27*a–c* and wider grooves 29*a–c*. Grooves 27*a–c* and 29*a–c* are formed by cutting through one layer of the coating and the core. Grooves 27*a–c* extend only part way through the core and grooves 29*a–c* extend fully through the core to the opposite coating. The grooves 29*a–c* provide points at which blanks 17*a–c* may be bent to define a frame for the storage units, i.e. they separate what will be top, sides, and bottom from each other. Blanks 17*c* and 19*c*, which form the double sided book shelf 1*c*, have a further groove 30 which extends the length of the blanks along a centerline thereof. When blanks 17*a–c* are bent into shape, blanks 19*a–c* are placed to form a frame assembly which forms the top, bottom and sides of the respective storage units. When blanks 17*a–c* and 19*a–c* are so assembled, the grooves 27*a–c* of a single wall are parallel to each other and aligned with the grooves on the opposing wall. Thus, shelf supports 15*a–c* are received in the grooves 27*a–c* formed in the tops and bottoms of the units and shelves 13*a–c* are received in the grooves 27*a–c* formed in the side walls. Groove or recess 30 of blanks 17*c* and 19*c* receive the centerboard 11*c* of the double sided bookcase. The grooves thus define guide channels which receive the shelves and their supports.

The shelf supports 15*a–c* and shelves 13*a–c* all include slots 31*a–c* and 33*a–c* respectively. The supports are slid into the frame assembly along the respective slots 27 with their respective slots 31 facing outwardly. After the supports 15*a–c* are inserted into the frame assembly, the shelves 13*a–c* are inserted into the assembly so that the slots 33*a–c* pass through the slots 31*a–c*. The interaction of the slots in this manner enables supports 15*a–c* to hold shelves 13*a–c* in position. Instead of slots or channels to support the shelves and shelf supports, other surface connecting means may be used to support these members.

The blanks 17*d* and 19*d* used to form locker 1*d* are shown in FIGS. 8A–G. The construction of the blanks is very similar to that of units 1*a–c*. Again, two blanks 17*d* and 19*d* are used to form the frame assembly. However, blank 17*d* forms only the top surface and a portion of the sides. Blank 19*d* forms the bottom surface and a lower portion of the sides. Each blank includes slots 27*d* and 29*d* which provide the bending points to form the frame and the channels which receive the shelf supports 15*d* and shelves 13*d*.

Figure 1A:
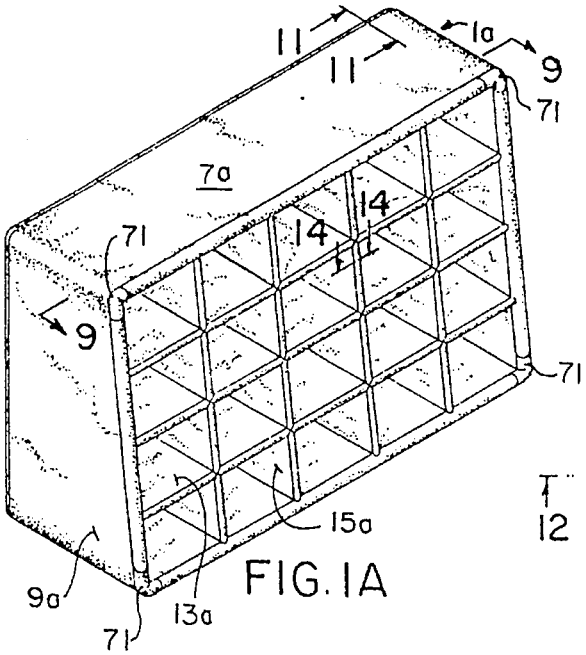
FIG. 1A is an isometric view of a cubby.
Figure 1B:
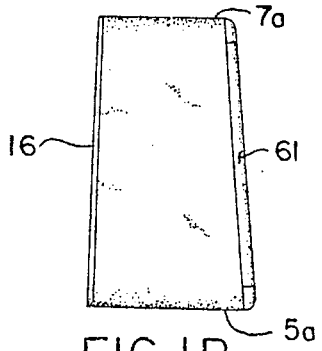
FIGS. 1B–F are side, top, front, back, and bottom views, respectively, of the cubby.
Figure 1C:
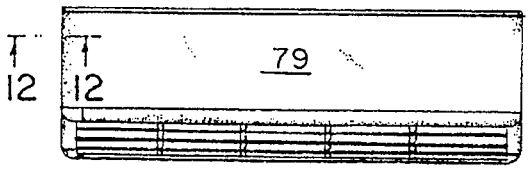
Figure 1D:
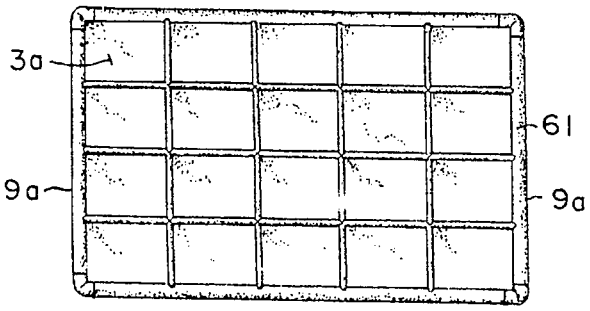
Figure 1E:
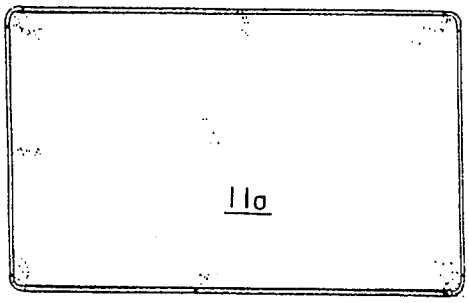
Figure 1F:
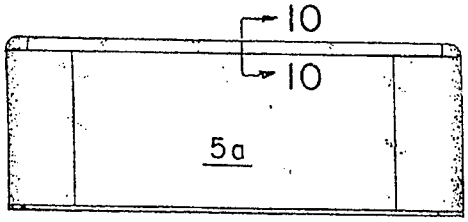
Figure 2A:
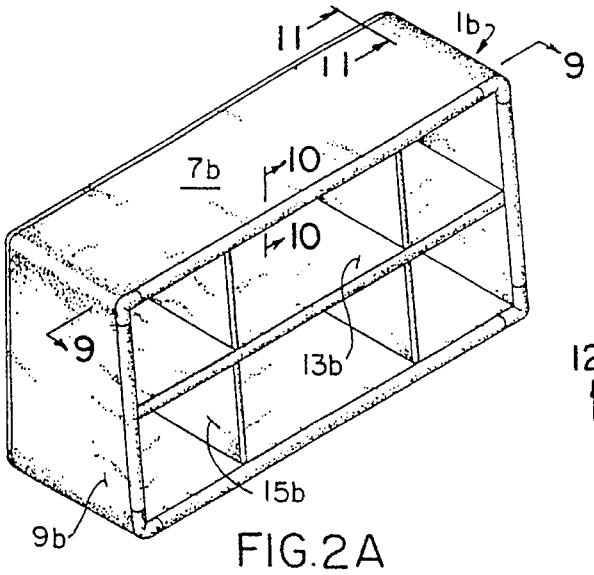
FIG. 2A is a perspective view of a book case.
Figure 2B:
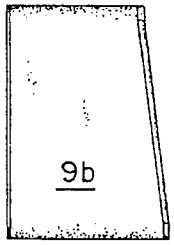
FIGS. 2B–F are side, top, bottom, back, and front views of the book case.
Figure 2C:
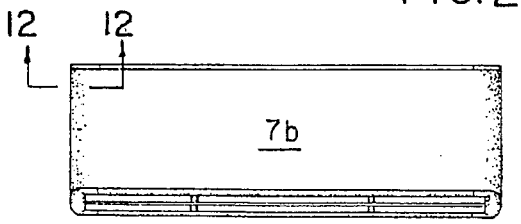
Figure 2D:
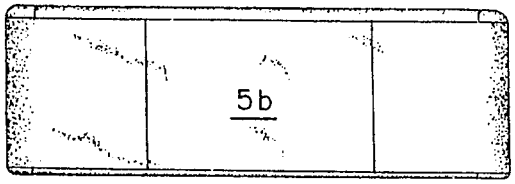
Figure 2E:
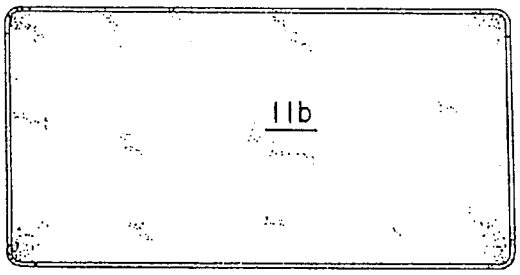
Figure 2F:
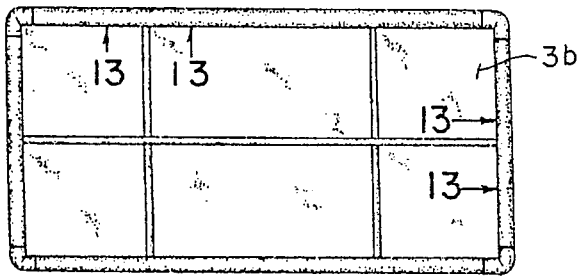
Figure 3A:
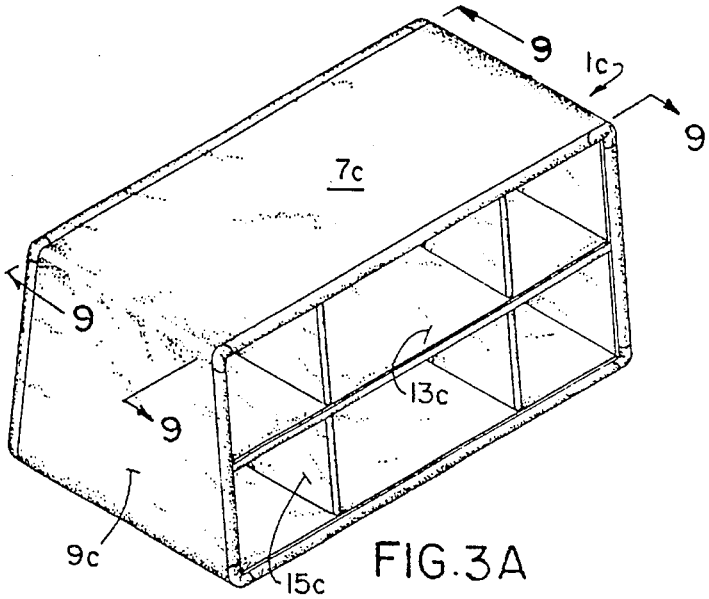
FIG. 3A is a perspective view of a double sided book case.
Figure 3B:
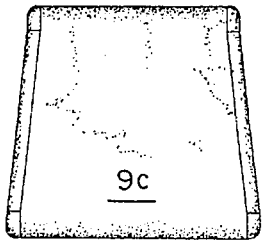
FIGS. 3B–E are side, front, top, and bottom views of the double sided book case.
Figure 3C:
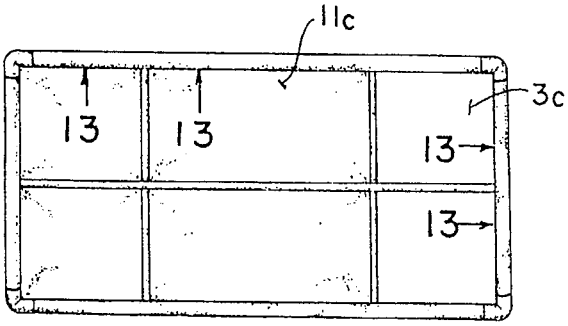
Figure 3D:
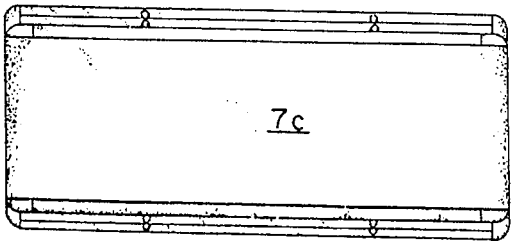
Figure 3E:
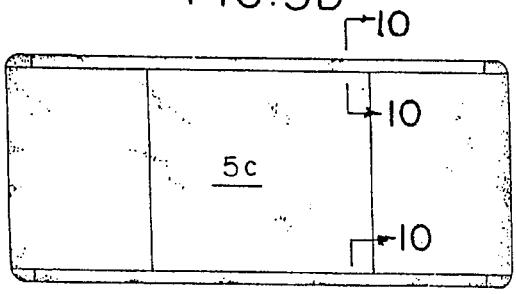
Figure 4A:
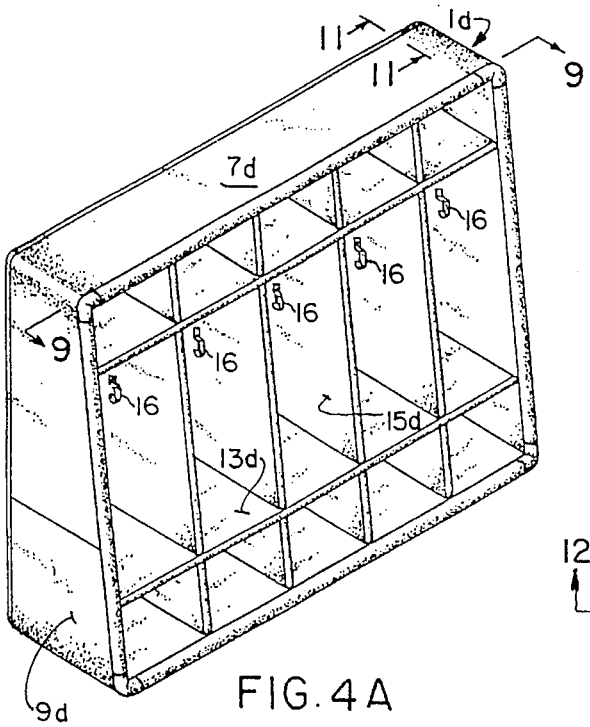
FIG. 4A is a perspective view of a locker.
Figure 4B:
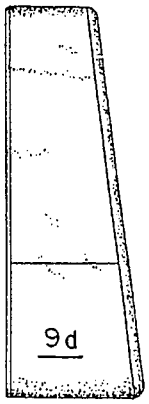
FIGS. 4B–F are side, top, front, back, and bottom views of the locker.
Figure 4C:
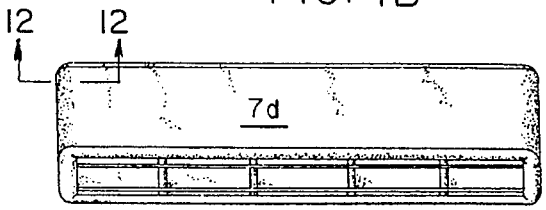
Figure 4D:
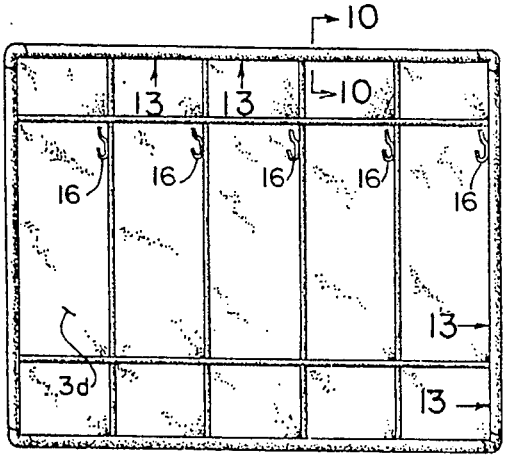
Figure 4E:
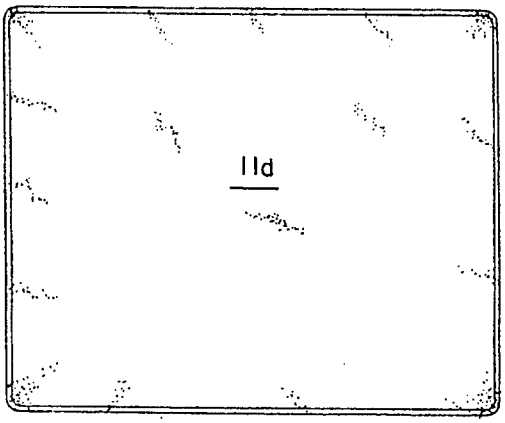
Figure 4F:
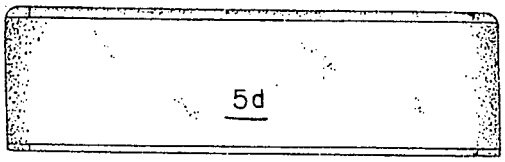
Figures 5A, 5B, 5C, 5D, 5E, 5F, 6A, 6B, 6C, 6D, 6E, 6F:
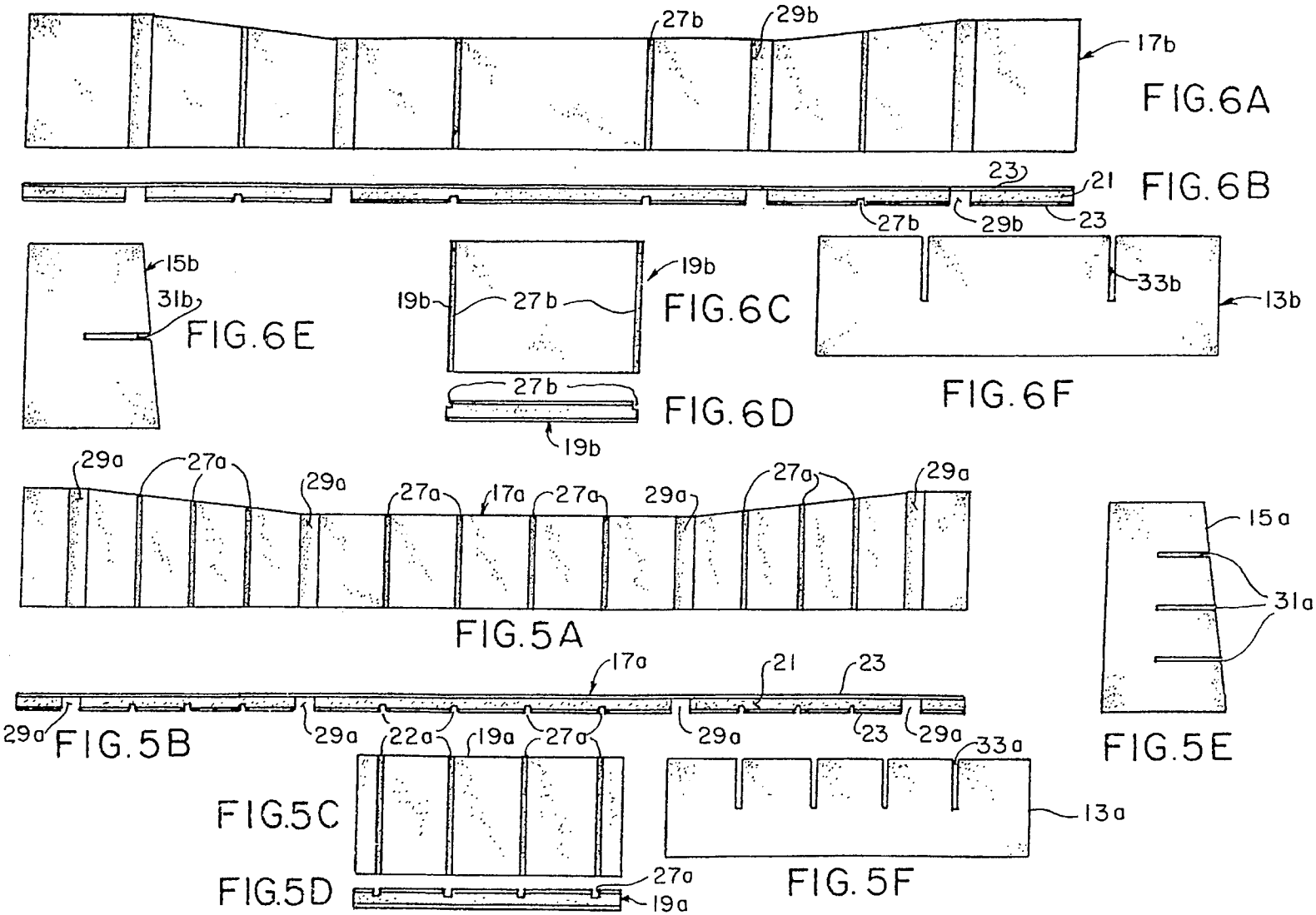
FIGS. 5A–B are top plan and side elevational views of a blank used to form the cubby.
FIGS. 5C–D are front and side views of a black of the cubby for forming a back thereof.
FIG. 5E is a side elevational view of a shelf supporter and separator of the cubby.
FIG. 5F is a plan view of a shelf piece of the cubby.
FIGS. 6A–B are top plan and side elevational views of a blank used to form the book case.
FIGS. 6C–D are front and side views of a blank of the book case for forming a back thereof.
FIG. 6E is a side elevational view of a shelf supporter and separator of the book case.
FIG. 6F is a plan view of a shelf piece of the book case.
Figures 7A, 7B, 7C, 7D, 7E, 7F, 8A, 8B, 8C, 8D, 8E, 8F, 8G:
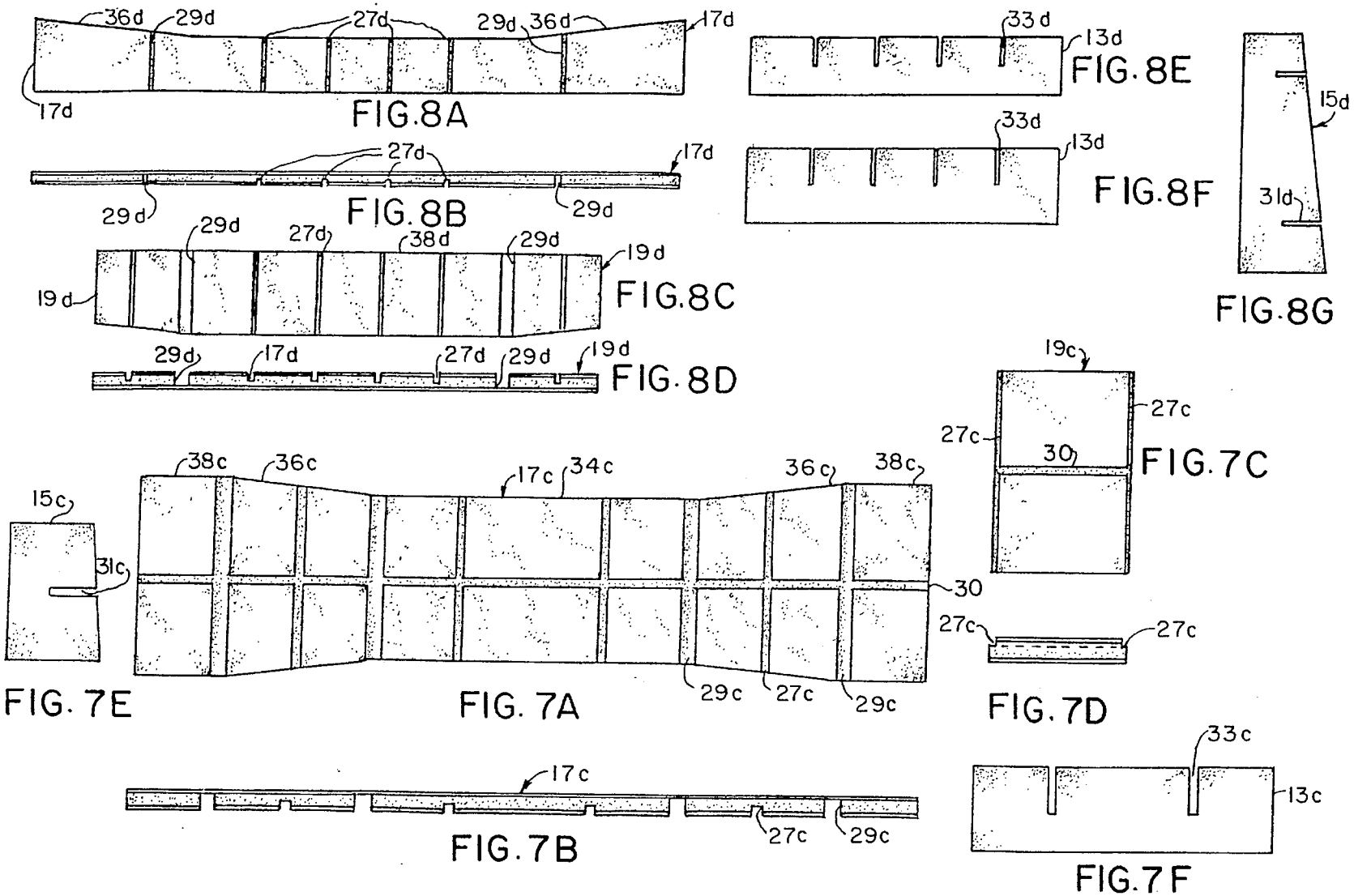
FIGS. 7A–B are top plan and side elevational views of a blank used to form the double sided book case.
FIGS. 7C–D are front and side views of a backing of the double sided book case for forming a bottom thereof.
FIG. 7E a side elevational view of a shelf supporter and separator of the double sided book case.
FIG. 7F is a plan view of a shelf piece of the double sided book case.
FIGS. 8A–B are plan and side views of a blank used to form a top portion of the locker.
FIGS. 8C–D are plan and side views of a blank used to form a bottom portion of the locker.
FIG. 8G a side elevational view of a shelf supporter and separator of the locker.

As can be seen, the blanks 17*a–d* and 19*a–d* have a shape which will form the shape of the respective storage units. Specifically, they all have a narrow middle section 34*a–d* which will define the tops 7*a–d*. The middle sections expand as at 36*a–d*. Portions 36*a–d* will form the sides of the storage unit. Blanks 17*a–c* further have rectangular end sections 38*a–c* which will form part of the bottoms of the storage units 1*a–c*. Turning to FIGS. 8A and 8C, it can be seen that the bottom blank 19*d* has a wide middle section 38*d* which will form the bottom of the locker. Section 38*d* narrows at its ends to form the sides. As can be appreciated, the sections 34, 36, and 38 are separated by grooves 29. With respect to blank 19*d*, the middle section 38*d* is separated from the narrowing end portions by grooves 29*d*.

Figure 14:
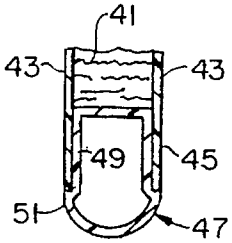
FIG. 14 is a cross-sectional view taken along line 14–14 of FIG. 1A.

Turning to FIG. 14, it can be seen that the structure of the shelves 13*a–d* is substantially similar to that of the blanks 17 and 19. The shelves include a core 41 made of the same materials as core 21 having a coating 43 on either side of the core. Liner 43 is made of the same materials as coating 23. Liners 43 extend beyond core 41 to define a channel 45. An extruded plastic finishing piece 47 is received in the channel 45. Finishing piece 47 has a generally rectangular base section 49 which frictionally fits or glued to seal the honeycomb at channel 45, and has a rounded head section 51. The rounded head 51 is exposed and is provided with some resiliency so that the units have no sharp or hard corners which could potentially injure children.

Figure 13:
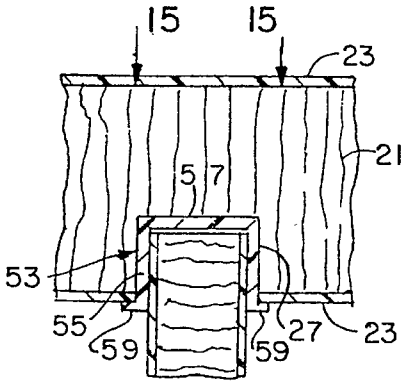
FIG. 13 is a cross-sectional view taken along line 13—13 of FIG. 2F, 3C, and 4D.

Turning to FIG. 13, it can be seen that the grooves 27 which receive the shelves and shelf supports are fitted with a guide 53. Guide 53 has sides 55 and a back 57 which are received in groove 27. Flanges 59 extend outwardly from the front of sides 55 and engage the surface or coating 23 of the blank 17 or 19. Guide 53 then receives the shelves and shelf supports. The guide is provided so that the insertion of the shelves and shelf supports into the grooves 27 will not damage the core 21 and hence weaken the structure.

Returning to FIG. 10, the forward edges of the top, bottom, and side walls are also fitted with extruded finishing pieces 61. Finishing pieces 61 have generally rectangular base portion 63 which is received in channel 25 and a rounded head portion 65 which is exposed. The head and base portions 65 and 63 are separated by a wall 67. Wall 67 adds structural integrity to the piece 61. The fit of portion 63 in channel 25 is very snug. The friction fit is sufficiently strong to hold the piece secured within the extensions of the two blanks of the frame assembly at this juncture. In addition, other types of finishing means could be employed to adhesively adhere the same together to achieve the same desired result. These portions 65 may be of resilient material, so as to function as cushioning means, and to prevent injury to children.

Corner pieces 71 (FIG. 9), substantially similar to pieces 61, are provided at the front corners of the units. The corner pieces have two legs 73 which form a generally right angle. The legs 73, at inner surfaces thereof, form a 90°. At outer surfaces of the legs, the legs are joined by a curved surface 75. The outer surface of the corner pieces is curved, complimentary to the finishing pieces 61. A lip 77 is formed at the ends of the legs 73 and extends outwardly from the legs. Lip 77 is formed along the the outer surface of the corner piece. The lip 77 is received in the finishing piece 61 to provide an area of joinder between pieces 61 and corner pieces 71.

Figure 11:
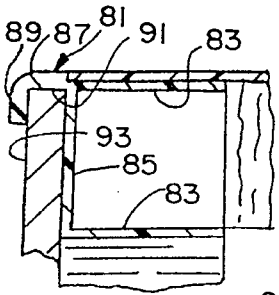
FIG. 11 is a cross-sectional view taken along line 11—11 of FIG. 1A, 2A, and 4A.

A back finishing piece 81 for use with units 1*a,b,d* is shown in FIG. 11. Piece 81 has two legs 83 which are received in channel 25 in a back edge of the walls of the storage units. The legs are joined by a web 85. An arm 87 extends outwardly from one of the legs and has a finger 89 which extends towards the other leg to define a recess or channel 91 which faces across web 85. Channel 91 receives backing material 93 which forms the back walls 11*a,c,d*.

Figure 9:
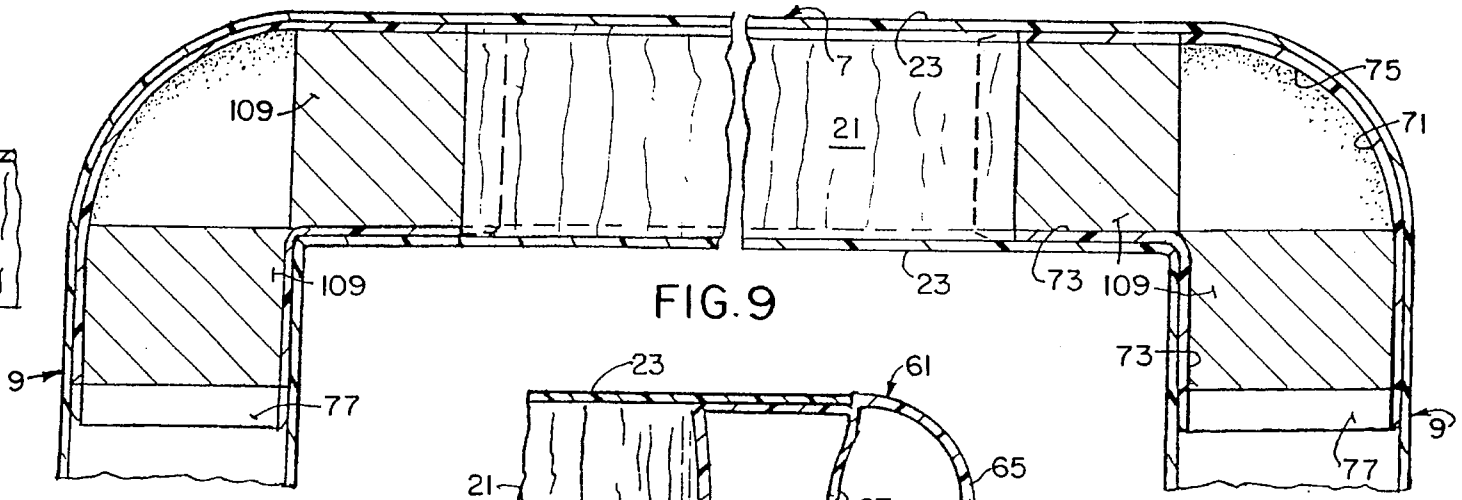
FIG. 9 is a cross-sectional view taken along line 9—9 of FIG. 1A.
Figure 12:
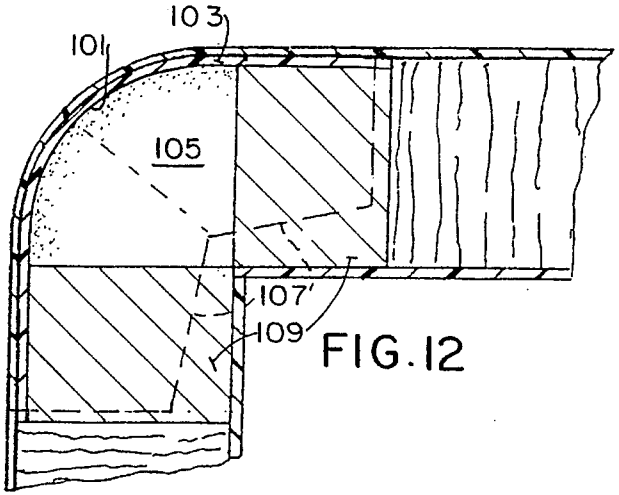
FIG. 12 is a cross-sectional view taken along line 12—12 of FIG. 1C.

Another corner piece 101 (FIG. 12) is applied to the back corners of the units 1*a,b,d*. Corner piece 101 has an outer curved wall 103 and a top surface 105 which form a pair of legs 107. Legs 107 are preferably tapered, as shown in phantom. When the corner grooves 29*a–d* are formed, part of the core is removed. To prevent the core from collapsing at these turns and corners, each corner is reinforced at the edges of the grooves 29*a–d* by blocks 109 which extend from the front of the unit to the back, inside of the corner pieces. The blocks 109 preferably butt up against the edges of the core, as seen in FIGS. 9 and 12. Also, the sustain the strength of each corner, it is possible that the core not be removed, as at 29*d* and 29*a*, and simply let the honeycombed paperback collapse, at this juncture, to enhance strength.

The construction of units 1*a–d* is fairly simple and no tools are required. The blanks 17 and 19, which have groove 27 and 29 already formed therein, are bent around grooves 29 and positioned together. The groove liners 53 are then placed in grooves 27 and the shelf supporters 15 and shelves 13 are placed in the units. In unit 1*c*, the centerboard is also placed in the frame assembly. If finishing pieces 47 have not already been applied to the shelves and shelf supports, they are inserted in the front edge of the shelves and shelf supports prior to insertion of the shelf supports and shelves into the frame assembly. The finishing pieces 61 and corner pieces 71 are placed along the front edges of the units. For unit 1*c* (the double sided book shelf) the pieces 61 and 71 are applied to both the front and the back edges of the units. The finishing pieces 87 are applied to the back edges of units 1*a,c,d* and the backing is put in place. For the lockers 1*d*, the hooks 16 can be added as a last step, or at any point along the way.

As can be appreciated, a strong and easily assembled structure is provided which may be used in nurseries, kindergarten classrooms and the like. The units are sufficiently strong to support the weight of small children. No sharp corners are provided to reduce the possibility of children being hurt on the units.

Variations within the scope of the appended claims may be apparent to those skilled in the art. The foregoing disclosure is thus meant for illustrative purposes only and is not meant to be limiting.

We claim:

1. A storage unit including a frame defining a top, bottom, and sides to said storage unit, at least one shelf member and at least one shelf supporting member;

said frame comprising a first blank forming said top and at least a part of said sides and a second blank forming at least a part of said bottom; each said blank having a core having upper and lower surfaces, each said upper and lower surfaces being covered with a liner, said liners extending beyond edges of said blanks to define a channel; at least said top blank having a pair of core grooves extending through one liner surface and said core, said core grooves defining bending points for said blank; said first and second blanks each defining at least one shelf groove for each of said top, bottom, and sides, said shelf groove extending through said one liner surface and at least a portion of said core, the shelf grooves of said top and bottom being aligned and the shelf grooves of said sides being aligned;

said shelf supporting member being received in said shelf grooves formed in the top and bottom of said frame, said shelf supporting member comprising a shelf supporting core having an upper and a lower surface and a second liner which covers each said surface, said second liners extending beyond at least a front edge of said shelf supporting member to define an edge channel; a first finishing piece received in said edge channel; at least one slot formed in said shelf supporting member and extending rearwardly from a front edge of said shelf supporting member;

said shelf member being received in said shelf grooves formed in the sides of said frame, said shelf member comprising a shelf core having an upper and a lower surface and a third liner which covers each said surface, said shelf liners extending beyond at least a front edge of said shelf supporting member to define another edge channel in a front edge of said shelf; a finishing piece received in said another edge channel; at least one slot formed in said shelf member and extending forwardly from said rear edge of said shelf supporting member;

said shelf member slot cooperating with said shelf supporting member slot such that said shelf member and shelf supporting member when assembled define a plurality of storage openings;

a backing for said storage openings; and a third finishing piece received in said channels of said blanks, said third finishing piece being snugly received in said channels to hold said blanks together without the use of fasteners.

2. The storage unit of claim 1 wherein said core of said blanks, said shelf member, and said shelf supporting member comprises one of corrugated paperboard, honey-combed paperboard, expanded foam, or expanded resin.

3. The storage unit of claim 1 including a guide which is received in each of the shelf grooves of said shelf member and shelf supporting member, said guide having a pair of walls defining a receiving channel and a flange extending outwardly from and maintained adjacent to said liner walls.

4. The storage unit of claim 3 including first, second and third finishing pieces for said shelf member and said shelf supporting member includes a generally hollow foot section received in said channels of said shelf member and said shelf supporting members and a head section extending outwardly from said channels, said head section having a generally curved surface.

5. The storage unit of claim 4 wherein said first, second and third finishing pieces for said frame comprises an elongate generally straight piece received in the core groove formed at junctions of said top, sides, and bottom.

6. The storage unit of claim 5 wherein each finishing piece has a foot section received in said channel and a generally curved head section extending from said channel, said generally straight finishing piece including a wall formed between said foot and head section.

7. The storage unit of claim 6 wherein said curved corner piece includes a front wall and a back wall joined by a web, said front and back walls being received in said channel, said web being generally arcuate and extending outwardly from said channel.

8. The storage unit of claim 7 wherein said curved and first, second and third finishing pieces interfit with each other; said curved finishing piece having a lip at an end of its legs, said lip being received in said straight finishing piece.

9. The storage unit of claim 7 wherein said blanks have a rear edge, and include a recess extending generally around the perimeter of said rear edges of said blanks, and being transverse to said shelf and shelf supporting mcrnber grooves, said recess receiving a wall which forms said backing.

10. The storage unit of claim 7 including a fourth finishing piece received in a channel defined along a back edge of said frame, said fourth finishing piece including a pair of legs which are received in said channel, a web extending between said legs, and an arm extending outwardly from one of said legs, said arm including a finger extending over said web, said web, arm, and finger defining a recess which receives said backing.

11. The storage unit of claim 10 wherein said first blank defines said top, sides, and a portion of said bottom.

12. The storage unit of claim 10 wherein said first blank defines said top and a top portion of said sides, said second blank defining said bottom and a bottom portion of said sides.

13. A storage unit forming one of a cabinet, bookcase, locker or cubby structure, including a frame defining a top, bottom, and sides to said storage unit, at least one shelf member and at least a shelf supporting member;

said frame comprising at least one blank forming the top, sides, and bottom of said storage unit, said blank having a core having upper and lower surfaces, said upper and lower surfaces being covered with a liner, said liner extending beyond edges of said blank to define an edge disposed channel;

said blank having a pair of core grooves extending through one liner surface and said core, said core grooves defining bending points for said blank, said blank defining at least one shelf groove for each of said top, bottom and sides, said shelf groove extending through said one liner surface and at least a portion of said core, the shelf grooves of said top and bottom being aligned, and the shelf grooves of said sides being aligned;

said shelf supporting member being received in said shelf grooves formed in the top and bottom of said frame, said shelf supporting member formed to provide support for any shelf member interconnected therewith, said liner extending beyond at least a front edge of said shelf supporting member to define a channel;

a first finishing piece received in said channel;

said shelf member being received in said shelf grooves formed in the sides of said frame, said shelf member comprising a length of shelf that extends from side to side within said frame, said shelf being supported by said shelf supporting member;

a backing for said storage unit opening; and a second finishing piece received in said edge channels of said blank, said finishing piece being snugly received in said edge channel to hold said blanks together without fire use of fasteners.

14. A storage unit forming one of a cabinet, bookcase, locker and cubby structure, including a frame defining a top, bottom, and sides to said storage unit, at least one shelf member and at least one shelf supporting member, said frame comprising at least one blank forming the top, sides and bottom of said storage unit, said blank having a core having upper and lower surfaces, said core being formed of one of corrugated paperboard, honey-combed paperboard, expanded foam, and expanded resin, said upper and lower surfaces of the core being covered with a liner, said liner extending beyond the edges of said blank to form a channel;

said blank being formed having corners at the juncture between its top, sides and bottom;

said blank having a pair of core grooves extending through one liner surface and said core, said core grooves defining bending points for said blank, said blank defining at least one shelf groove for each of the top, bottom, and sides, said shelf groove extending through the said inner liner surface and at least a portion of said core, said shelf grooves of said top and bottom being aligned and the shelf grooves of said sides being aligned;

said shelf supporting member being received in said shelf grooves formed in the top and bottom of said frame;

said shelf supporting member formed to provide support for any shelf interconnected therewith;

said shelf member being received in said shelf grooves formed in the sides of said frame, said shelf member comprising a length that extends from side to side within said frame, said shelf being supported by said shelf supporting member;

a backing for said storage unit opening, and a finishing piece connecting with the from edge of said core and liners within their formed channel to provide a finishing appearance to the front edges of said storage unit.

15. The storage unit of claim 14 wherein the bottom of said storage unit has a greater depth dimension than the depth of the top of said storage unit, wherein the stability of said unit is enhanced during usage.

16. The storage unit of claim 14 wherein said finishing piece is resilient.

17. A storage unit forming a cabinet, bookcase, locker or cubby structure, including a frame defining a top, bottom and sides, to said storage unit, and at least one shelf member, and at least one shelf supporting member;

said frame comprising at least one blank forming the top, sides, and bottom of said storage unit, said blank having a core having upper and lower surfaces, and said upper and lower surfaces being covered with a liner, said liners extending beyond the core to form an edge channel;

said blank having a pair of core grooves extending at least through one liner surface, said core grooves defining bending points for said blank, for forming at least the top and sides of said storage unit, said blank defining connecting means for each of said top, bottom and sides, the connecting means of said top and bottom comprising shelf supporting grooves, and said shelf supporting grooves of the top and bottom being aligned, and the connecting means of said sides comprising shelf grooves, and said shelf grooves being horizontally aligned;

said shelf supporting members secured within the shelf supporting grooves associated with the top and bottom of said frame, said shelf supporting member formed to provide support for a shelf interconnected therewith;

said shelf member being secured within the shelf grooves provided within the sides of said frame, said shelf member comprising a length of shelf that extends from side to side within said frame, said shelf member being supported within the shelf grooves and the said shelf supporting member;

a backing for said storage unit opening, said frame having a rear edge, said backing being secured to the rear edge of said storage unit;

said core being formed of one of corrugated paperboard, honeycomb paperboard, expanded foam, and expanded resin; and said connecting means further comprises at least one guide for each of said top, bottom, and sides formed within said shelf and shelf supporting grooves, said guides extending through at least one liner surface, and at least a portion of said core the guides of said top and bottom being aligned, and the guides of said sides being aligned, said shelf supporting member being received within the guides formed in the top and the bottom of said frame, and said shelf member being received in the guides formed in the sides of said frame.

* * * * *

UNITED STATES PATENT AND TRADEMARK OFFICE

CERTIFICATE OF CORRECTION

PATENT NO. : 5,605,389

DATED : Feb. 25, 1997

INVENTOR(S) : Ray G. Kelly, et al.

It is certified that error appears in the above-indentified patent and that said Letters Patent is hereby corrected as shown below:

Claim 1, column 7, line 24, change "a finishing" to ---a second finishing---.

Claim 13, column 8, line 62, change "fire" to ---the---.

Claim 14, column 9, line 29, change "from" to ---front---.

Signed and Sealed this

Fifteenth Day of July, 1997

Bruce Lehman

*Attest:*

BRUCE LEHMAN

*Attesting Officer*

*Commissioner of Patents and Trademarks*